United States Patent [19]

Bodig et al.

[11] 4,382,431

[45] May 10, 1983

[54] CIRCUIT FOR DECREASING OSCILLATOINS IN THE PRIMARY WINDING OF AN IGNITION COIL OF AN INTERNAL COMBUSTION ENGINE

[75] Inventors: Bernd Bodig, Leinfelden; Werner Jundt, Ludwigsburg, both of Fed. Rep. of Germany

[73] Assignee: Robert Bosch GmbH, Stuttgart, Fed. Rep. of Germany

[21] Appl. No.: 229,122

[22] Filed: Jan. 28, 1981

[30] Foreign Application Priority Data

Feb. 27, 1980 [DE] Fed. Rep. of Germany ..... 3007335

[51] Int. Cl.[3] ..... F02P 3/04

[52] U.S. Cl. ..... 123/644; 123/651; 315/209 T

[58] Field of Search ..... 123/644, 651; 315/209 T, 224

[56] References Cited

U.S. PATENT DOCUMENTS 3,605,713 9/1971 Le Masters et al. ..... 123/644

3,838,672 10/1974 Richards et al. ..... 123/644

4,245,610 1/1981 Sugiura ..... 123/644

*Primary Examiner*—Tony M. Argenbright

*Assistant Examiner*—Andrew M. Dolinar

*Attorney, Agent, or Firm*—Frishauf, Holtz, Goodman & Woodward

[57] ABSTRACT

Oscillations which would normally occur when the current in the primary winding of an ignition coil is limited to a predetermined value prior to ignition are suppressed by use of a feedback resistor. Specifically, the basic circuit consists of the primary winding of the ignition coil connected in series with a Darlington transistor configuration which, in turn, is connected in series with a measuring resistor, at a common point. The input of the current control system is connected to the common point through an additional resistor, while the output of the control circuit is connected to the input base of the Darlington configuration. Oscillations which might otherwise occur are suppressed by the use of a feedback resistor connected between the input and output lines of the control circuit.

1 Claim, 1 Drawing Figure

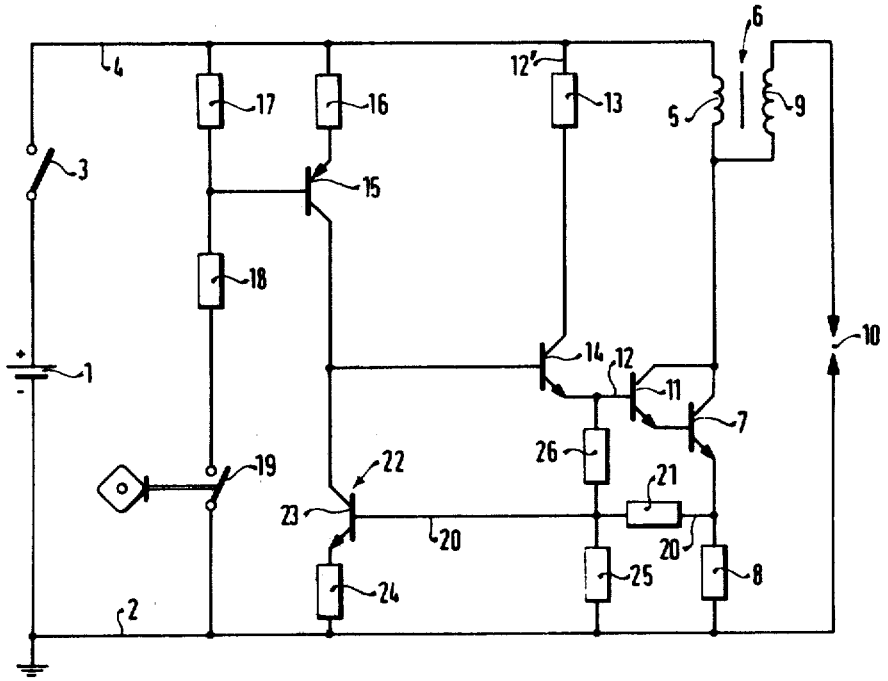
6
4
12'
17
16
13
5
9
3
15
18
10
14
12
1
11
7
26
19
22
21
23
20
20
25
8
24
2

CIRCUIT FOR DECREASING OSCILLATOINS IN THE PRIMARY WINDING OF AN IGNITION COIL OF AN INTERNAL COMBUSTION ENGINE

CROSS-REFERENCE TO RELATED APPLICATIONS AND PUBLICATIONS (1) U.S. application Ser. No. 60,772, now U.S. Pat. No. 4,271,812
Filed: July 26, 1979
Corresponding to DE-OS 28 33 343;
(2) DE-OS 28 33 343.

The present invention relates to ignition systems in internal combustion engines and, more particularly, to systems which prevent oscillations across the primary winding during the limiting of the current therethrough.

BACKGROUND OF THE INVENTION

The present invention concerns ignition systems in which a spark is generated in order to ignite an air-fuel mixture in the cylinder of an internal combustion engine. In these ignition systems, the ignition coil has a primary winding and a secondary winding. An emitter-collector circuit of a switching transistor is connected in series with the primary winding. A measuring resistor is connected in series with the emitter-collector circuit of the switching transistor. The current for controlling the switching transistor is furnished by a control circuit which has an input line connected, generally through a resistor, to a common point of the emitter-collector circuit of the switching transistor and measuring resistor. The control circuit further has an output line which supplies the control current for the switching transistor. The control circuit prevents further increases of the current through the primary winding of the ignition coil after a predetermined value required for sufficient energy storage for ignition has been reached.

In the known circuits, oscillations are created in the primary winding at the ignition coil, and therefore across the emitter-collector circuit of the switching transistor when the limiting process takes effect. These oscillations are particularly undesirable during diagnostic testing since an incorrect adjustment of the ignition system can result from incorrect measurements created by such oscillations.

THE INVENTION

It is an object of the present invention to prevent the above-mentioned oscillations.

In accordance with the present invention, a feedback resistor is connected between the input and output line of the control circuit. This prevents occurrence of the above-mentioned oscillations.

DRAWING DESCRIBING A PREFERRED EMBODIMENT

The single FIGURE is a circuit diagram showing the feedback resistor of the present invention connected to an ignition system.

DESCRIPTION OF THE PREFERRED EMBODIMENT

The ignition system illustrated in the FIGURE is part of an internal combustion engine which is in a motor vehicle. The energy is supplied by a source of DC current 1 which may be the battery of the vehicle. The negative side of battery 1 is connected to ground or chassis potential while the positive line is connected to one terminal of an ignition switch 3. The other terminal of ignition switch 3 is connected to a supply line 4. A series circuit including the primary winding 5 of ignition coil 6, the emitter-collector circuit of a switching transistor 7, and a measuring resistor 8 is connected from supply line 4 to ground potential. The secondary winding 9 of ignition coil 6 is connected to one side of a spark plug 10 whose other side is at ground potential.

Switching transistor 7 is connected in a Darlington circuit configuration with an npn transistor 11. The collectors of transistors 7 and 11 are connected to each other, while the emitter of transistor 11 is connected to the base of transistor 7.

The base of transistor 11 is connected to the output line 12 of a control circuit. The control circuit includes a transistor 14 whose emitter is connected to line 12 while its collector is connected to line 4 through a resistor 13. The base of transistor 14 is connected to the tap of a voltage divider. The voltage divider includes a resistor 16, the emitter-collector circuit of an npn transistor 15, the emitter-collector circuit of a transistor 23 and a resistor 24. The tap of the voltage divider is the common point of the collector transistor 15 and that of transistor 23. The base of transistor 15 is connected to the common point of a resistor 17 and a resistor 18. The other side of resistor 17 is connected to line 4, while the other side of resistor 18 is connected to one terminal of an interrupter switch 19. Interrupter switch 19 operates under control of the engine. The other terminal of interrupter switch 19 is connected to ground potential. Transistors 14 and 23 together constitute a control circuit which limits the current through the primary winding 5 of ignition coil 6 when the value of the latter has reached a predetermined value at which sufficient energy for ignition will be stored in the ignition coil. A resistor 25 is connected between line 20 and ground potential, and a feedback resistor 26 is connected between input line 20 and output line 12 of the control circuit.

OPERATION

As soon as switch 3 is closed, the apparatus is ready for operation. It will first be assumed that interrupter switch has just been closed. This causes the emitter-collector circuits of transistors 7,11,14 and 15 to become conductive. The current through primary winding 5 increases. When a predetermined value of this current is reached, the voltage drop across resistor 8 is sufficiently high to cause transistor 23 to become sufficiently conductive so that the current through primary winding 5, as controlled by the current in line 12, remains at this predetermined value. Feedback resistor 26 suppresses oscillations which, without this resistor, would appear in the circuit containing primary winding 5 of ignition coil 6.

This may be explained as follows: First, a voltage drop must occur across resistor 25 which is sufficient to cause the emitter-collector circuit of transistor 23 to become conductive. The current through resistor 25 consists of the sum of currents through resistors 26 and 21. When the current through primary winding 5 of ignition coil 6 reaches the predetermined value, transistors 7 and 11 are at first overdriven. This causes the base-emitter voltage of transistors 7 and 11 to be relatively high and therefore causes a relatively high current to flow through resistor 26. The current flowing through resistor 21 will be less than that through resistor 26. This allows transistor 23 to become conductive even before the current through primary winding 5 reaches the predetermined value. If transistors 7 and 11 are then driven into their active region, the voltage across their emitter-base junctions decreases and thus, correspondingly, the current through resistor 26 decreases. This decrease in current must be compensated for by an increase in current through resistor 21, that is, the voltage drop across resistor 8 and therefore the current through primary winding 5 will continue to increase. This finally results in a slow transition into the controlled condition.

If interrupter switch 19 is then opened, the emitter-collector circuits of transistors 7, 11, 14 and 15 are switched to the blocked state. This causes the current through primary winding 5 to be interrupted, thereby causing a high voltage pulse to be generated in secondary winding 9 of the ignition coil. This high voltage pulse causes a spark to be created at spark plug 10.

If, finally, interrupter switch 19 is again closed, the above-described cycle will be repeated.

Various changes and modifications could be made to the circuit shown in the FIGURE. For example, transistor 23 could be replaced by an operational amplifier whose inverting input would be connected to line 20 while its direct input would be connected to a reference voltage as, for example, the tap of a voltage divider connected between supply line 4 and ground or chassis potential. The output of the operational amplifier would be connected to the base of transistor 14.

Further, interrupter switch 19 could be replaced by the emitter-collector circuit of a transistor which is part of a contactless signal generator unit.

Various changes and modifications may be made within the scope of the inventive concepts.

Specific values of the various components in the circuit in a preferred embodiment are:

-continued

| | | |
|---|---|---|
| Transistor 7: | Back-voltage = | 400 Volts |
| | on-state current = | 5 Amperes |
| Primary winding 5 of ignition coil 6: | | |
| | Resistance = | 0,6 Ohms |
| | Inductance = | 5,5 Milihenries |
| Resistor 8: | 0,2 Ohms | |
| Resistor 13: | 60 Ohms | |
| Resistor 16: | 1 Kiloohm | |
| Resistor 21: | 1,5 Kiloohms | |
| Resistor 24: | 10 Ohms | |
| Resistor 25: | 2,5 Kiloohms | |
| Resistor 26: | 6,2 Kiloohms | |

We claim:

1. In an ignition system having a source of electrical energy (1), ignition coil means having a primary winding (5) ignition switch means (3) for connecting said primary winding to said source of electrical energy when closed, semiconductor switch means (7,11) having emitter, collector and base electrodes and having its emitter-collector path connected in series with said primary winding, measuring resistor means (8) connected in series with said path of said switch means at a first common point, control circuit means (22,14) comprising an input transistor (23), an output transistor (14), and an output line (12) connecting said output transistor to said semiconductor switch means for supplying control current thereto, said control circuit also having an input line connected to a base of said input transistor and additional resistor means (21) interconnected between said first common point and said input line, said control circuit limiting control current to said semiconductor switch means when the current through said primary winding reaches a predetermined value: the improvement comprising a feedback circuit branch composed entirely of an ohmic resistance (26) connected directly between said input line and said output line of said control circuit means for preventing oscillations across said primary winding from resulting from said limiting of said current through said primary winding.

* * * * *